US005632201A

United States Patent [19]

Roch

[11] Patent Number: 5,632,201

[45] Date of Patent: May 27, 1997

[54] PROCESS AND DEVICE FOR CONTROLLING THE HUMIDITY OF A WEB ON A PRINTING MACHINE

[75] Inventor: Roger H. Roch, Cossonay-Ville, Switzerland

[73] Assignee: Bobst SA, Lausanne, Switzerland

[21] Appl. No.: 616,821

[22] Filed: Mar. 15, 1996

[30] Foreign Application Priority Data

Mar. 17, 1995 [CH] Switzerland ..... 00766/95

[51] Int. Cl.[6] ..... B41M 1/14; B41F 5/22

[52] U.S. Cl. ..... 101/211; 101/248; 101/487; 34/446

[58] Field of Search ..... 101/487, 488, 101/483, 211, 181, 248, 178, 219; 34/446

[56] References Cited

U.S. PATENT DOCUMENTS

| | | | |
|---|---|---|---|
| 4,029,008 | 6/1977 | Mabrouk | 101/148 |
| 4,366,753 | 1/1983 | Glanz | 101/181 |
| 4,763,424 | 8/1988 | Taylor et al. | 34/446 |
| 4,798,136 | 1/1989 | Tittgemeyer et al. | 101/485 |
| 4,887,530 | 12/1989 | Sainio | 101/181 |
| 5,036,764 | 8/1991 | Rodi | 101/211 |
| 5,056,430 | 10/1991 | Bayerlein et al. | 101/211 |
| 5,195,435 | 3/1993 | Morrone et al. | 101/170 |
| 5,361,960 | 11/1994 | Fokos et al. | 101/248 |

FOREIGN PATENT DOCUMENTS 4327646 4/1994 Germany .

*Primary Examiner*—Eugene H. Eickholt
*Attorney, Agent, or Firm*—Hill, Steadman & Simpson

[57] ABSTRACT

A process for correcting misregistration between imprinted images from successive printing stations comprising measuring the width of the imprinted image of each station and comparing the width to determine any difference, and creating a correction signal if a difference does exist to change the humidity in the web passing through the printing unit. The device includes photoelectric devices for determining the width of each image created at each station, an electronic device for comparing the width of each image and, if a difference exists, creating an error signal which is applied to the first drying unit and a secondary error signal applied to the second unit to correct the humidity of the web leaving each dryer.

11 Claims, 2 Drawing Sheets

PROCESS AND DEVICE FOR CONTROLLING THE HUMIDITY OF A WEB ON A PRINTING MACHINE

BACKGROUND OF THE INVENTION

The present invention is directed to a process and device to control the humidity of a web material, such as a paper web or a cardboard web within a color printing machine, which has several printing stations with each station printing a single basic color that is superimposed on the preceding printed color.

Such a printing machine normally comprises a lengthwise and/or sidewise registry control device for printing. The device is usually based on detection by one or several photocells, or other detectors, of the position of marks printed side-by-side and/or consecutively in the margin for each station. A calculator receives all the signals from the detectors and permanently determines the lengthwise and sidewise misregistration and applies correction signals for displacing the compensation rollers and the printing cylinders in order to rectify any misregistration.

Owing to such a control device for the registration of one printing with the others, it is possible with a precision, which is less than a tenth of a millimeter, to superimpose the printing image of one color on the other image at the place where the marks of the reference are located. However, a sidewise residual displacement of printing images outside the area where the marks are printed frequently occurs and such a displacement could be up to several tenths of a millimeter and make the final printed image unacceptable outside the areas adjoining the marks. This phenomenon is more especially visible in webs as large as three meters or thereabout, and when the printing is a fine printing, such as a negative writing because a displacement of a tenth of a millimeter is sufficient to make the printing unreadable in the area removed sidewise from the registration marks.

Afterwards, as will be understood, this sidewise residual displacement is due to, for the most part, variations of the dimensions of the web at one printing station with respect to another printing station, due to variations in the humidity of the sheet or web. As a matter of fact, in photogravure printing, for example, the ink which was made very liquid by solvents is collected outside of a pan by cells of a printing cylinder and is put by capillary action onto the paper web. This ink has to be dried before printing the next color, in order to avoid any mixing or running therebetween. This drying is realized in a progressively volatilization of the solvents between two printing groups or stations. If necessary, this volatilization is accelerated in a dryer wherein warm air or hot air is blown onto the web.

Owing to this inking and drying, the humidity of the web leaving a station depends on many factors, such as the quality of the paper, the quality of the ink, the width of the printing, the humidity of the paper before printing, the humidity and the temperature of the air in the dryer, the duration of drying and the travelling or processing speed of the web in the machine. Therefore, it was established that a variation of 1% of humidity of a paper web does change the transverse dimensions of the web by 0.1%, which means that for a web 3 meters wide, a variation of 3 millimeters will occur.

Thus, after making sure that the registry control device in the center of the image works properly, one of the machine operator's tasks consists of checking the adjustment of the printing of the webs or boards as well. If the operator detects a sidewise or transverse residual error, the operator will then intervene manually with the dryers to adjust at best the humidity of the web between the stations. This manual adjustment is, however, tedious, and only qualified persons are able to accomplish the proper adjustments.

U.S. Pat. No. 4,798,136, whose disclosure is incorporated herein by reference thereto, describes a process and device for automatic register control of printing images, excluding the printing mark in the edge and based on reading the physical width of the web at the entry of each station. The width of the web is measured by two side sensors with each sensor having a rod which at one end is carrying a wheel in contact with the web section, and the other extremity or end of the rod is carrying a magnet shifting in from of two electromagnetic windings to determine the position of the end. When the calculator detects a variation of the width of the web from one station to another, the calculator only changes the efficiency of the preceding dryer, thus, changing the temperature of the drying rollers which are in contact with the web and heated by an electrical resistance or by hot water or by vapor or the calculator modifies the airflow or the electrical heating of the air being blown into the drying station.

It is easy to understand that, contrary to what is stated in this patent, the described system could not replace an equipment of control of the lengthwise and sidewise misregistration working with reference marks in the printing. As a matter of fact, many causes for perturbation of the register will exist, for example, inhomogeneousity of the web causing a sidewise drift, variations of the coefficient of the elasticity causing a lengthwise drift, variations of the introduction tension, inertia and frictions of the idler rollers, which need a position rectification of the printing elements with the position of one element being changed with regard to the other elements. Thus, the system is not useful at all.

Moreover, regarding the correction of the variations of the printing width, in practice, the efficiency of the device is distinctly insufficient to maintain registration of the printing images, especially fine printing images, in the edge of a wide web, which is travelling at high speed. Already, when starting, it is rare that the width of the web is rigorously constant for the whole roll. The initial irregularities are inducing non-adequate corrections by this system of the patent.

SUMMARY OF THE INVENTION

The object of the present invention is to obviate the above-mentioned disadvantages and proposing a process and a device to control the humidity of the web within a color printing machine. The invention provides a process, which has greater performance regarding the provisions of the adjustment of the printing images relative to the other images and is more dynamic regarding the feedback time. Preferably, such a process has to be able to take the anticipated results as a basis, that is to say the regularity of the width of the printing in succession. Moreover, the conception of the device to make use of the process has to be kept simple to obtain a reasonable cost and for easy maintenance of the device.

These aims are achieved owing to a process to control the humidity of the web within a color printing machine, including the steps of measuring the width of the printing image executed by a station and the width of the printing image executed by the next following station, comparing the widths and, if there is a difference not equal to zero, creating a correction signal and applying said signal to one or several parameters of the dryer of the first-mentions printing station to create a difference of zero and then generating a secondary signal of a decreasing amount of correction of the same parameter and applying these secondary signals to each following dryer of the printing station.

Since a primary correction is made on the upstream dryer, in anticipation, secondary corrections are made on each of the downstream dryers. This is for taking the primary modification of the humidity of the web and to effect a drying realized by each downstream dryer into consideration, the dynamics of the general correction is increased materially resulting in a final correct and rapid adjustment.

According to the preferred form of realization, the correction signals apply on the quantity of the injected vapor into the drying air being blown into the dryers.

This quantity of injected vapor notably allows an imposition of a predetermined value of humidity on this drying air. Now, the function which gives the humidity of the drying web is a curve decreasing in time to an asymptote, as a logarithmic function whose base is included between zero and one, or as a function of a power with a negative index, whose value of a lower asymptote is the value of the humidity of the blown air. Thus, by modulating the value of humidity of the air, the curve of drying of the paper is modified very fast and very efficiently so that the humidity of the web leaving the dryer after a delay, which value is determined according to the dryer's length and tape speed.

Many tests in the workshop enabled us to discover that the first secondary correction preferably has to be included between 7% and 50% of the amount of the first or primary correction and that the second secondary correction is to include between 1% and 15% of the primary correction.

Preferably, the width of the successive printing images are measured when leaving the printing machine in order to permit an examination of the evolution of the errors from one station to another and to determine the way of the secondary correction with regard to this evolution or progress.

A device according to the present invention especially created to implement the process comprises photoelectric means detecting the position of a mark on the fight and a mark on the left to determine the width of the printing image realized by one station and detecting the position of the marks on the right and the left to determine the width of the printing image created by the following stations, electronic means receiving the signals of the photoelectric means and providing a possible difference of the width from one printing image to another image, an electric calculator means connected to the electronic means generating in the case of a difference not equal to zero a primary electric error signal for correction and applying on the regulating means of a heating of a plate or a roller which is in contact with the web or the flow on the regulating means of the heating and/or percentage of water vapor of the dryer of the station to correct the value of the humidity of the web to an initial value had by the web when entering the machine and generating a second electric error signal of a decreased correction and applying it to the same means of regulation for each following dryer of the printing machine.

This device comprises the first means already used for the adjustment of the sidewise and lengthwise registration. So, by completing the algorithms and the numerical database of the electronic calculator, advantageously, the calculator could be simply connected to an electromagnetic valve or to an electric circuit board for the control of dryer motors, or to supply boards for electrical resistance of the heating elements, which motors and supply boards are conventional and exist on the market. Thus, the construction cost of this device according to the invention remains under control.

Preferably, the electrical error signals for correction are applied on valves for control of the water vapor injected into the drying air which is to be blown into each of the dryers. A feedback is applied to the electronic calculator means so that if the valve engages either an opening stop or a closing stop, a corresponding signal can then be applied to the heating elements for the air being blown into the selected dryer.

Other advantages and features of the invention will be readily apparent from the following description of the preferred embodiments, the drawings and claims.

DESCRIPTION OF THE PREFERRED EMBODIMENTS

Figure 1:
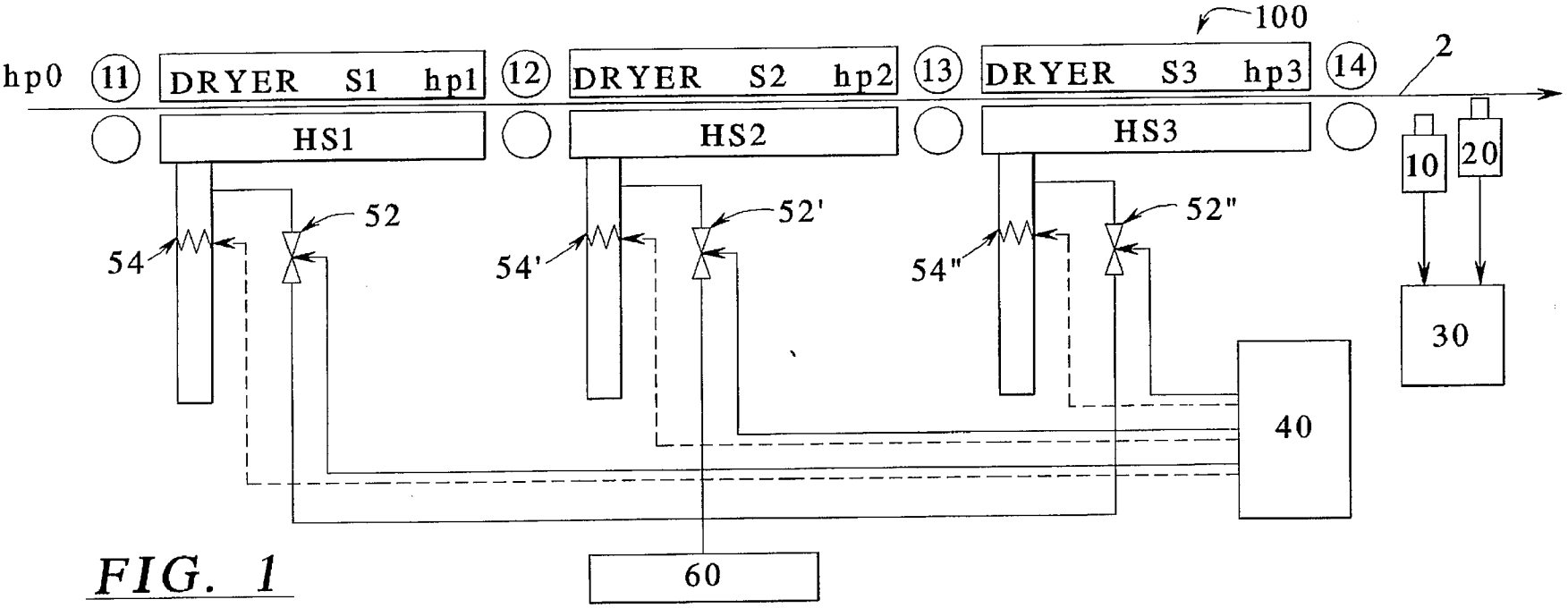
FIG. 1 is a diagrammatic illustration of a printing machine having the control means in accordance with the present invention.

The principles of the present invention are particularly useful in a device, generally indicated at 100 in FIG. 1, for printing color images on a web 2, such as a web of paper or cardboard. The printing machine 100 is, for example, a photogravure-type printing machine and has four printing stations or groups I1, I2, I3 and I4, which are illustrated as printing cylinders. The first group I1 is printing yellow, the second group I2 is printing red, the third group I3 is printing blue and the last group I4 is printing black, to give the contrast for the final image. In the case of an offset printing machine, the colors would be printed in the opposite order, from the darkest to the lightest. In this machine, it is necessary to completely dry the printing of one color before applying the next following color, and this is in order to avoid any mixing or blurring therebetween. In addition, the ink applied by a group of printing rollers or cylinders could increase the humidity of the web of paper which will tend to expand, and it is recommended to correct the humidity to the original amount to obtain the original dimension before the next following printing operation. So, on the illustrated examples, the web of paper 2 enters into the machine with an initial humidity hp0 and leaves a first dryer S1 of the first station with a humidity hp1 before being printed by the printing group I2. After being printed by the printing rolls I2, it then passes through a second dryer to obtain the respective humidity hp2 before reaching the third group of rollers I3 and after leaving the third group I3, passes through a third dryer S3 to obtain a humidity hp3 before reaching the fourth group I4.

More particularly, according to the invention, double photoelectric means are foreseen, which contain a device for detecting marks on the fight side of the web and marks on the left side of the web. As illustrated, this includes a detector 10 for the marks on the fight side and a detector 20 for the marks on the left side. These photoelectric means allow to detect the sidewise pairs of the marks which are successively printed by each printing group I1, I2, I3 and I4, and the marks of one pair are located beside each other with their respective printings or imprinted images.

Each detecting device comprises, first, a fight source projecting a light spot on the corresponding mark of the web. Each device comprises, then, photoelectric cells receiving directly or through the optical fibers the reflected light which is effected by the travel of a mare Alternatively, these detectors could be two CCD cameras which are taking a "photograph" of a group of marks on a light flash synchronized with the movement of the web.

The signals generated by these detecting photoelectric means 10 and 20 are applied to electronic means 30, such as a board of image processing, which determines at the first time the effective width of each of the imprinted images formed by the groups I1, I2, I3 and I4. These effective widths will be determined by the position of the right and left marks. Then, afterwards, these electronic means establish the eventual difference of one printing image to the next and produced values of the error and, as well, an evolution of the changes along the printing machine. The numerical data represented in these differences of the successive widths are applied to the calculator means 40, which establishes in terms to the algorithms and the table of preregistered parameters correction signals for each dryer S1, S2 and S3 according to a process, whose specifications are as follows.

Preferably, according to the invention, the correct signals made by the calculator means 40 are applied, first, on electromagnetic valves 52, 52' and 52" for a control of water vapor, which is created by water in a tank 60 and is injected into air being blown into each of the dryers. In this manner, the humidity of the air blown on the web is fixed to a precise value HS1 into the dryer S1, HS2 into the dryer S2 and HS3 into the dryer S3.

If one of the valves 52, 52' or 52" engages a stop position, which is either completely open or completely closed, a feedback signal will, thus, have the controller create a second signal to act on electrical resistance respectively 54, 54' and 54" to allow a modification of the heating of the drying air in a manner to maintain the relative humidity HS of the respective dryer to the desired value.

Figure 2:
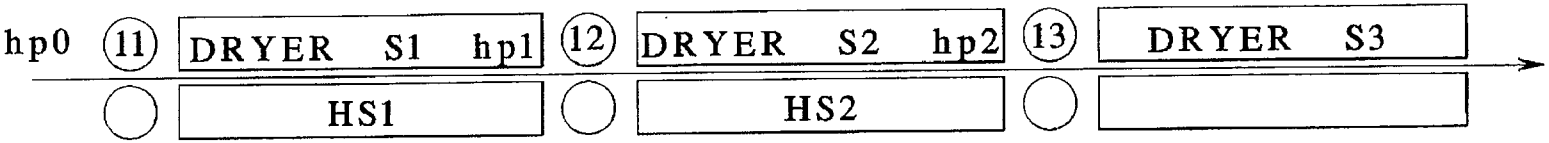
FIG. 2 is a diagrammatic illustration of the different stations of the printing machine.
Figure 3:
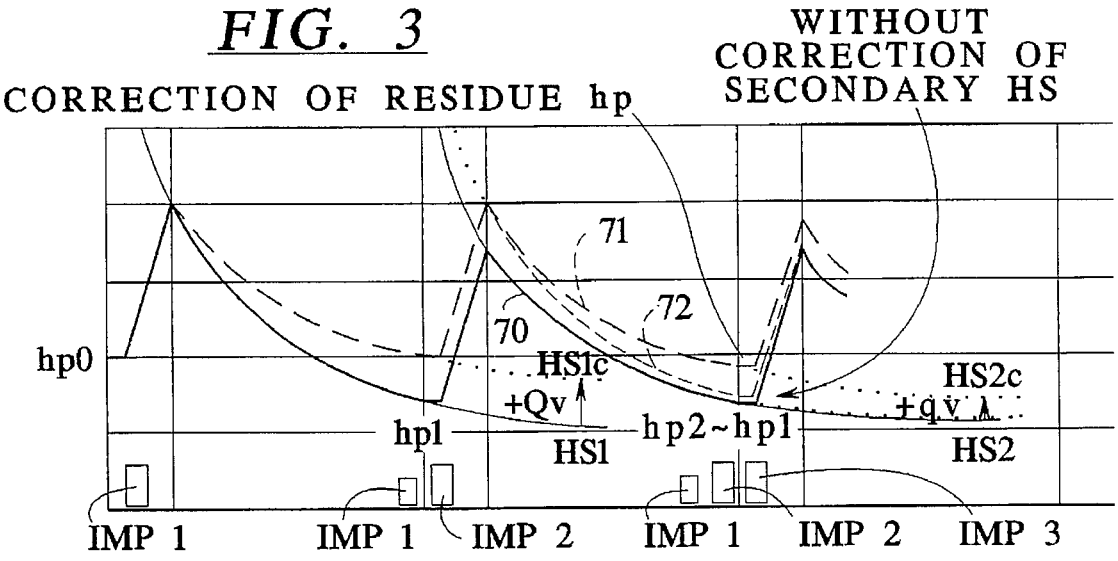
FIG. 3 is a schematic diagram showing changes in the humidity of the web of paper travelling from station to station of the machine of FIG. 2 when the first printing image is narrower than the following printing images.
Figure 4:
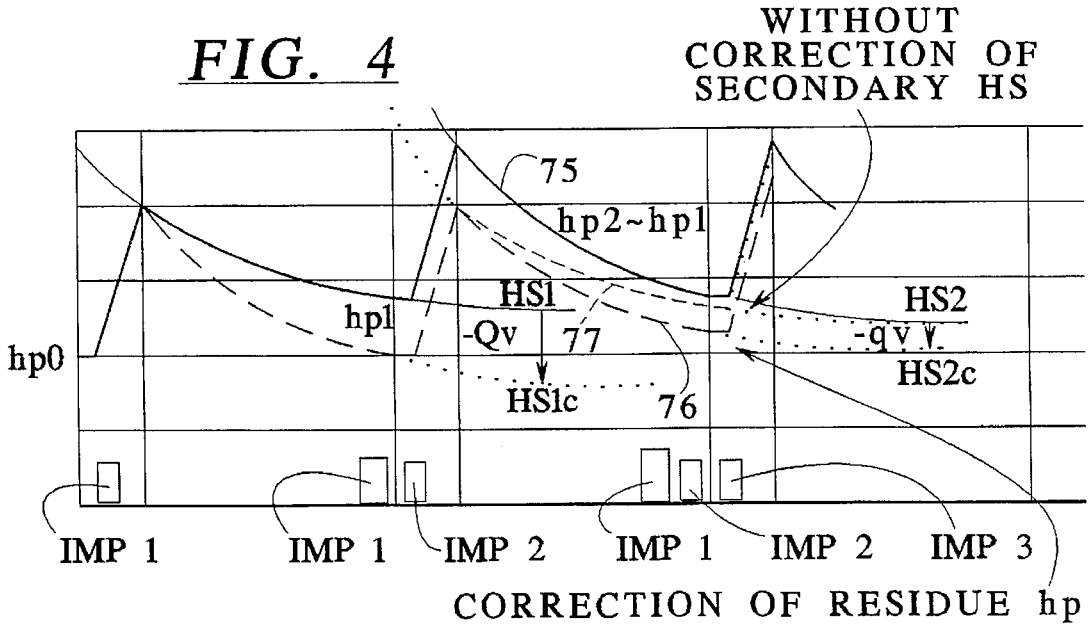
FIG. 4 is a schematic diagram of the changes in the humidity when the first printing image is of a greater size than the following printing images.
Figure 5:
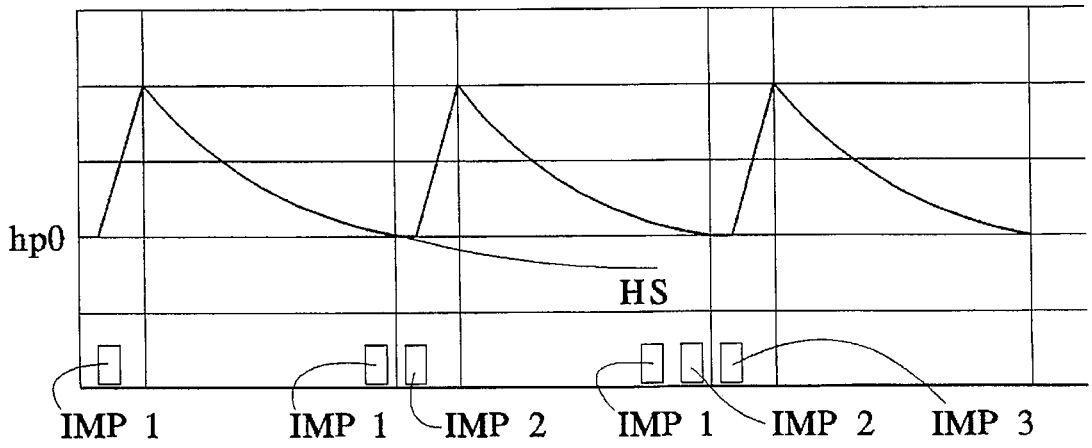
FIG. 5 is a schematic diagram when there is perfect registry retained between the first, second and third printing images.

The working method of the above-described device is more particularly illustrated in reference to FIGS. 3–5, which represent, in the Y-axis, the evolution or progress of the humidity of the paper along the printing machine illustrated in the abscissa of FIG. 2, and this illustrates different situations.

FIG. 5 illustrates the ideal situation, wherein the web of paper entering into the printing machine with an initial humidity hp0 is dried systematically back to the same value hp0 before the next printing so that the printings or imprinted images IMP1, IMP2 and IMP3, which are spaced along the abscissa, appear with a width rigorously identical when leaving their respective units.

In the illustration, an equal width of the imprint images IMP1 and IMP2 are supposed and were subject to an identical increase of humidity of the web and need identical action of drying as well. In the contrary case, it is suitable to adjust the width of drying with regard to the width of printing.

In the example, the effect of drying of the humidity of the paper is represented by a decreasing asymptotical curve, such as a standard logarithm reversed or a standard function of power with a negative index and whose value of asymptote is corresponding to the value of humidity HS of the blown air. As will be obviously understood, the exact form of this curve of drying depends on numerous factors from which would include, among others, the length of the dryer, the profile of the variation along the dryer, which would be either the flow or the temperature of the blown air, and possibly the presence of heating elements being in contact with the web. In the illustrated example of FIG. 5, the ideal result of the dryers S1 and S2 is to correct systematically the humidity of the web to its initial value hp0.

FIG. 3 illustrates a first situation of out of balance, wherein the imprint or image IMP1 is leaving more narrow than the printing images IMP2 and IMP3, which are rigorously of the same width. This is due to the fact, as illustrated by the solid-line curve 70, that the value of humidity hp1 of the web leaving the dryer S1 is perceptively identical to the humidity hp2 of the web leaving the dryer S2, and these two humidities, on the other hand, are perceptively below the initial humidity hp0 at the entry into the printing device. The imprint IMP1, after being correctly printed, due to excessive drying, is contracted when it arrives at the second printing group 12 and the third group I3.

According to the present invention, when acting on the adjustment of the electromagnetic valve 52 of FIG. 1, the injected water vapor is increased by an amount +Qv in order to increase the humidity of the air being blown into the dryer S1 to a corrected value HS1*c*. The result of this is to modify immediately the effect of drying according to the illustrated curve 71 in dashed lines, as far as to correct the humidity hp1 of the web leaving the dryer S1 to be perceptively identical to the entering humidity hp0.

According to the present invention, the first correction +Qv of the vapor injected into the air of the dryer S1 is simultaneously accompanied by a second correction +qv of vapor injected into the air blown into the second dryer S2 so as to cause the humidity of the initial value HS2 in the second dryer S2 to be corrected to a second value HS2*c*.

As a matter of fact, since the humidity hp1 of the paper leaving the dryer S1 has been increased, the effect of drying without correction in the dryer S2 would have increased the humidity as well, to follow the curve 72 in the short dashed line, which is between the solid line curve 70 and the large dash curve 71. This intermediate correction increases the humidity almost to the same initial value, and this would cause an unbalanced width between the imprints IMP1 and IMP2, on the one hand, and the imprint IMP3, on the other hand. As will be easily understood in regarding the curve 71 illustrated by the long dash lines, the result of the secondary correction +qv is to increase simultaneously the humidity hp2 of the paper leaving the dryer S2 and, like this, only one residual slight correction is necessary at the second iteration to come back to the ideal example according to FIG. 5. In other words, an anticipated +qv of the secondary correction by a primary correction +Qv has perceptively accelerated the process of restoring the desired situation.

In FIG. 4, a reverse situation of imbalance occurs in which the first printing appears too large when leaving the dryer S1 with regard to the imprints IMP2 and IMP3, which are supposed to be identical as well. As illustrated by the solid line curve 75, this is due to the fact that the humidity hp1 of the web leaving the dryer S1 is perceptively the same as the humidity hp2 leaving the dryer S2, and both are too high with regard to the initial humidity of the web hp0.

A primary correction −Qv in a manner of a decrease in the quantity of the vapor injected into the air blown into the dryer S1 will lead the humidity of this air from a value HS1 to a corrected value HS1*c* shown by the curve 76 of large dashes to cause the value of the humidity hp1 leaving the dryer S1 to be perceptively equal to the initial value hp0. However, this decrease in the humidity leaving the dryer S1 results in a decrease in the efficiency of the dryer S2 in such a way that, according to the curve 77 of short dashes line, the humidity hp2 remains perceptively on its initial value. Owing to a secondary correction −qv executed simultaneously with the correction −Qv, the humidity of the air blown into the dryer S2 is leading, as well, from a value HS2 to a lower corrected value HS2*c* shown by curve 76 in such a way that the humidity hp2 of the web leaving the dryer S2 is reduced and let only one residual small correction for a second iteration to come back rapidly to the ideal situation of FIG. 5.

In the situation of FIG. 3, the secondary correction +qv realized in the same way as the primary correction +Qv turns out useful when the imprints IMP2 and IMP3 are identical or the imprint IMP2 is also smaller than the imprint IMP3 as well. In the reverse order, if the photoelectric means 10 and 20 and the electronic means 30 establish previously that the imprint IMP3 is, itself, smaller than the imprint IMP2, then the calculator means 40 reverses the way or direction of the secondary correction to −qv. In a similar manner, in the illustrated situation of FIG. 4, the secondary correction qv realized in the same way to be substractive to the primary correction Qv is useful when the imprints IMP2 and IMP3 are identical or when the imprint IMP3 is also smaller than the imprint IMP2. On the other hand, if the photoelectric means 10 and 20 and the electronic means 30 detect that the imprint IMP3 is too large with regard to the imprint IMP2, then the calculator 40 will apply a secondary correction qv with a reverse sign to that of the primary correction Qv.

The calculator means 40 could obtain an algorithm which is treating each of the possible configurations of the evolution of the four-color printing widths along a printing machine and, for each configuration, applies in one way or the other secondary corrections on the downstream dryer in addition to the primary correction to the upstream dryer with these secondary corrections being decreased.

The importance of the secondary correction depends amply on the geometry of the dryers. For example, a primary correction of 100 units results in a secondary correction foreseen in a range of 8 to 50 units in the immediately following dryer and about 1 to 15 units in the ultimate or last dryer. In other words, the second dryer will have a correction of 8% to 50% of the correction of the first dryer and the third downstream dryer will have a correction of 1% to 15%.

Although various minor modifications may be suggested by those versed in the art, it should be understood that I wish to embody within the scope of the patent granted hereon all such modifications as reasonably and properly come within the scope of my contribution to the art.

I claim:

1. A process to control the humidity of a web within a color printing machine, said process comprising the steps of measuring the width of an imprinted image of a first printing station, the width of the imprinted image of the next following printing station, determining the differences between the widths and, if the differences are not equal to zero, generating a primary error signal of correction for applying to one or several parameters of the drying station to create a zero difference between the measurements, and generating a secondary signal of a decreased correction for the same parameter and applying the secondary signal to each drying station following the first drying station.

2. A process according to claim 1, wherein the step of measuring the widths of the imprinted images effected by each of the printing stations measures the widths as the web is leaving the printing machine to enable an examination of the progress of error from one station to another and to determine the mount and direction of correction for the secondary corrections applied to the second and following printing station.

3. A process according to claim 1, wherein the step of applying the correction signals applies the signals to adjust the quantity of vapor injected into the drying air being blown into each of the respective dryers.

4. A process according to claim 3, wherein the step of measuring the widths of successive imprinted images measures the web as it leaves the printing machine in order to enable an examination of the progress of errors from one station to another and to determine the mount and direction of the secondary corrections with regard to this progress.

5. A process according to claim 3, wherein the amount of correction decreases from the first station to the second station to the third station.

6. A process according to claim 5, wherein the amount of correction of the first secondary correction applied to the second station is in a range of 7% to 50% of the correction to the first station and the amount of correction in the following third station is in an amount of 1% to 15% of the correction applied to the first station.

7. A process according to claim 6, wherein the step of measuring the widths of the imprinted images of the first station and the following station are accomplished when the web leaves the last station of the printing machine in order to permit an examination of the progress of errors from one station to the other and to determine the type of correction for the secondary corrections with regard to this progress.

8. A process according to claim 5, wherein the step of measuring measures the widths of the successive imprinted images as the web is leaving the printing machine in order to permit an examination of the progress of errors from one station to the following station and to determine the type of secondary corrections to be applied.

9. A device for controlling humidity in a web passing through a printing station, said device comprising a photoelectric means for detecting the position of marks on the right and on the left of an imprinted image of a first printing station and imprinted images of each following station, electronic means for receiving the signals of the photoelectric means and establishing any difference in the widths from one imprint image to another, electronic calculating means receiving an output of the electronic means and generating, in the case of a difference not equal to zero, a primary electrical error signal for correction applying on regulating means for a dryer following the first priming station selected from a group consisting of regulating the heating of an element in contact with the web, regulating an element in the flow, regulating the flow of heating air, and regulating the percentage of water vapor injected into the drying station to correct the value of humidity of the web to the initial value of the web when entering the machine and generating a secondary electrical error signal of a decreased correction and applying the secondary signal to the same regulating means in the next following dryer of the machine.

10. A device according to claim 9, wherein the electrical error signals of correction are applied to valves controlling the water vapor injected into the drying air being blown into each dryer.

11. A device according to claim 10, wherein a feedback of the position of the valve is provided so that if the valve engages an opening or a closing stop, the remaining signal is applied to regulating the heating of the air being utilized in the dryer station.

* * * * *